US006424314B1

(12) United States Patent
Baghdasarian et al.

(10) Patent No.: US 6,424,314 B1
(45) Date of Patent: Jul. 23, 2002

(54) FOUR AXIS BOOM FOR MOUNTING REFLECTOR ON SATELLITE

(75) Inventors: Varouj G. Baghdasarian, Cupertino; Colin Francis, Redwood City, both of CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/859,077

(22) Filed: May 16, 2001

(51) Int. Cl.[7] ..... H01Q 3/02
(52) U.S. Cl. ..... 343/882; 343/766; 343/DIG. 2
(58) Field of Search ..... 343/878, 882, 343/757, 758, 755, 765, 766, 912, 915; 248/183.1, 183.2, 184.1, 664, 665, 666, 667, 669; 244/158 R, 173

(56) References Cited

U.S. PATENT DOCUMENTS

| | | | | |
|---|---|---|---|---|
| 5,673,459 A | | 10/1997 | Baghdasarian | 16/308 |
| 5,828,347 A | * | 10/1998 | Rossi et al. | 244/158 R |
| 5,864,320 A | | 1/1999 | Baghdasarian | 343/757 |
| 5,963,182 A | * | 10/1999 | Bassily | 343/881 |
| 5,966,104 A | * | 10/1999 | Massey et al. | 343/881 |
| 6,243,051 B1 | * | 6/2001 | Vanstrum et al. | 343/895 |

* cited by examiner

*Primary Examiner*—Tan Ho
(74) *Attorney, Agent, or Firm*—Perman & Green, LLP

(57) ABSTRACT

A support for a deployable reflector for use on a modular satellite antenna assembly is constructed of an elongated boom supported at both ends by a pair of two axis actuators. The boom is attached at its inboard end to the satellite structure in close proximity to the point of attachment of the associated signal feed assembly to minimize the differential thermal stress throughout the antenna assembly.

8 Claims, 8 Drawing Sheets

FOUR AXIS BOOM FOR MOUNTING REFLECTOR ON SATELLITE

FIELD OF THE INVENTION

The present invention is directed to a mounting structure for a reflector which is deployed from a stowed position during launch to an extended position when the satellite obtains orbit. The deployed reflector is aligned with its associated feed horn and sub-reflector in the deployed position.

BACKGROUND OF THE INVENTION

Space satellites require antennas for signal reception and/or transmission. Such satellites and antennas must be relatively lightweight, strong, capable of being stowed into compact condition, and capable of being activated remotely into deployed condition in which they are operational for their intended purposes. The antenna systems generally consist of a reflector, feed horn, and a sub-reflector. It is generally desirable to use antenna reflectors which are attached to the supporting spacecraft platform by hinges so that they can be pivoted up against the sides of the spacecraft in a streamlined stowed position during the launching of the spacecraft. Once the satellite is launched into orbit, the reflector may be deployed by pivoting the reflector away from the body of the satellite into its operational position.

As shown in FIG. 1, a single axis mounting structure is used to connect the reflector to the spacecraft body. The mounting structure consists of a hinge secured to the bottom of the spacecraft which allows actuators associated with the hinge to swing the reflector outward for operational deployment. A mounting structure of this type is described in commonly owned U.S. Pat. No. 5,673,459. Deployment in the system of the '459 patent is actuated by a bias spring which pivots the reflector outward upon release of hold-downs.

Reflectors must be maintained in alignment with its signal source or target after deployment. This is particularly critical in communication applications where the reflector needs to be accurately aligned with its associated signal feed horn. Therefore in some applications it is necessary to adjust the position of the reflector further to obtain full operational deployment. Deployment in such applications, may involve rotating the antenna supports on a hinge axis to unfold the reflectors to a position in which they extend perpendicular to the sides of the spacecraft, and also rotating the reflectors about a second axis, perpendicular to the first axis, to aim the reflectors in the direction of the signal source or target. Actuators which provide such two axis movement have been devised as illustrated in U.S. Pat. No. 5,864,320.

It has been found that the alignment between reflector and feed can be significantly distorted by differential thermal stress between the two elements. This distortion is compounded in the configurations of the prior art by mounting the reflector at the bottom of the spacecraft body and mounting the feed horn at the top. This distance is mandated by the aligned physical relation between reflector and feed and the limited amount of movement available for deployment. Generally the feed remains fixed and the reflector moves into the deployed position.

It is a purpose of this invention to minimize the thermal differential between the reflector and feed and thereby maintain the aligned relation in the deployed position. Another purpose of this invention is to mount the reflector support structure in close proximity to the feed apparatus. It is a purpose of this invention to accomplish the deployment using multiple two axis actuators. In addition it is a purpose of this invention to provide a antenna sub-module incorporating these features which will facilitate the testing and installation of the antenna system.

SUMMARY OF THE INVENTION

A satellite antenna sub-module is constructed in which the signal feed and sub reflector are secured in a fixed mutual relation on a frame which is to be, in turn, assembled within a spacecraft/satellite. The associated primary reflector is mounted on the frame by means of a support boom at a location on or in close proximity to the feed attachment point. The attachment points of the primary reflector boom and the associated feed horn and sub-reflector are positioned as close as possible in order to minimize thermal distortion throughout the reflector system. The boom is connected at one end to the frame by means of a two axis actuator which provides powered rotary motion about two orthogonal axis'. The reflector is mounted at the other end of the boom by a second similar two axis actuator.

By sequentially rotating the boom and reflector through a series of movements, the reflector is deployed from its stowed position, where it is secured for launch, to its fully deployed position, in which it extends outward from the side of the space craft for operation in alignment with its feed horn and sub-reflector.

The reflector system described above is constructed for use in satellites having multiple antenna which must be stowed in a nested relation to present a streamlined contour for the exterior of the spacecraft while the craft is being launched into orbit. To properly nest the multiple antenna they are mounted in pairs on independent booms as described above.

DESCRIPTION OF THE DRAWINGS

The present invention will now be described by way of example with reference to the accompanying drawings, wherein like reference numerals refer to like elements, and in which.

DESCRIPTION OF THE PREFERRED EMBODIMENT

Figure 1:
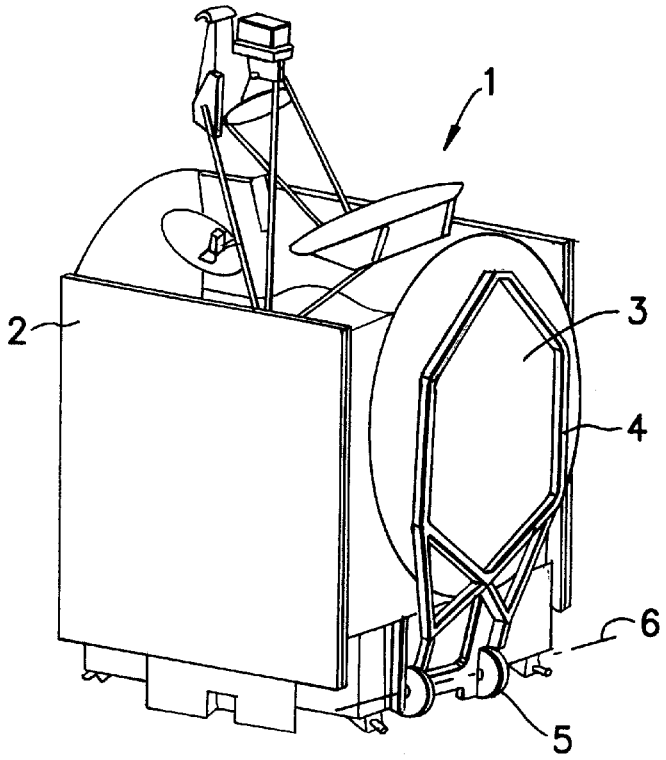
FIG. 1 PRIOR ART
FIG. 1 is a perspective view of a satellite having a reflector mounted on a single axis hinge according to the prior art.

A typical mounting system of the prior art is shown in FIG. 1 in which a satellite 1 is shown. A reflector 3 is mounted through a frame 4 to a hinge 5 for pivotal movement about axis 6. The hinge 5 is secured to the body 2 of the satellite 1 at the bottom of the satellite 1. To provide alignment between the reflector 3 and a signal feed (not shown), the signal feed is mounted at the top of the satellite. This is necessitated, at least in part by the limited movement allowed by the reflector on hinge 5. It has been found that a significant thermal differential can occur between the top and the bottom of the satellite 1 as it is launched and positioned in orbit. This thermal differential can cause distortion in the reflector mounting structure which may result in misalignment of the reflector with its associated signal feed after deployment.

Figure 2:
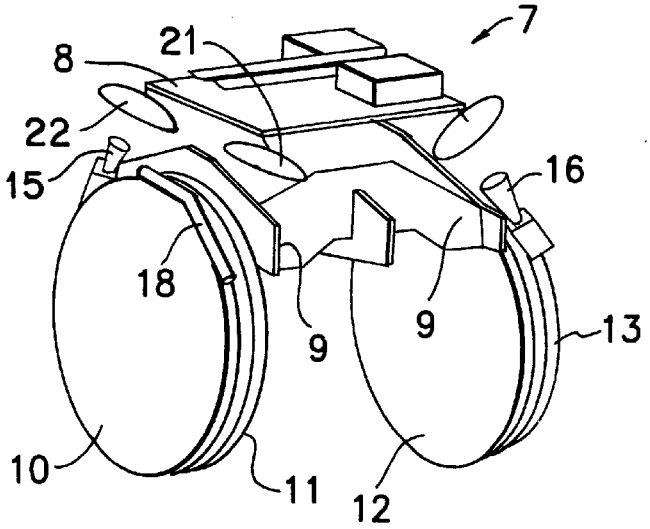
FIG. 2 is a perspective view of a satellite antenna sub-module constructed according to the subject invention.
Figure 3:
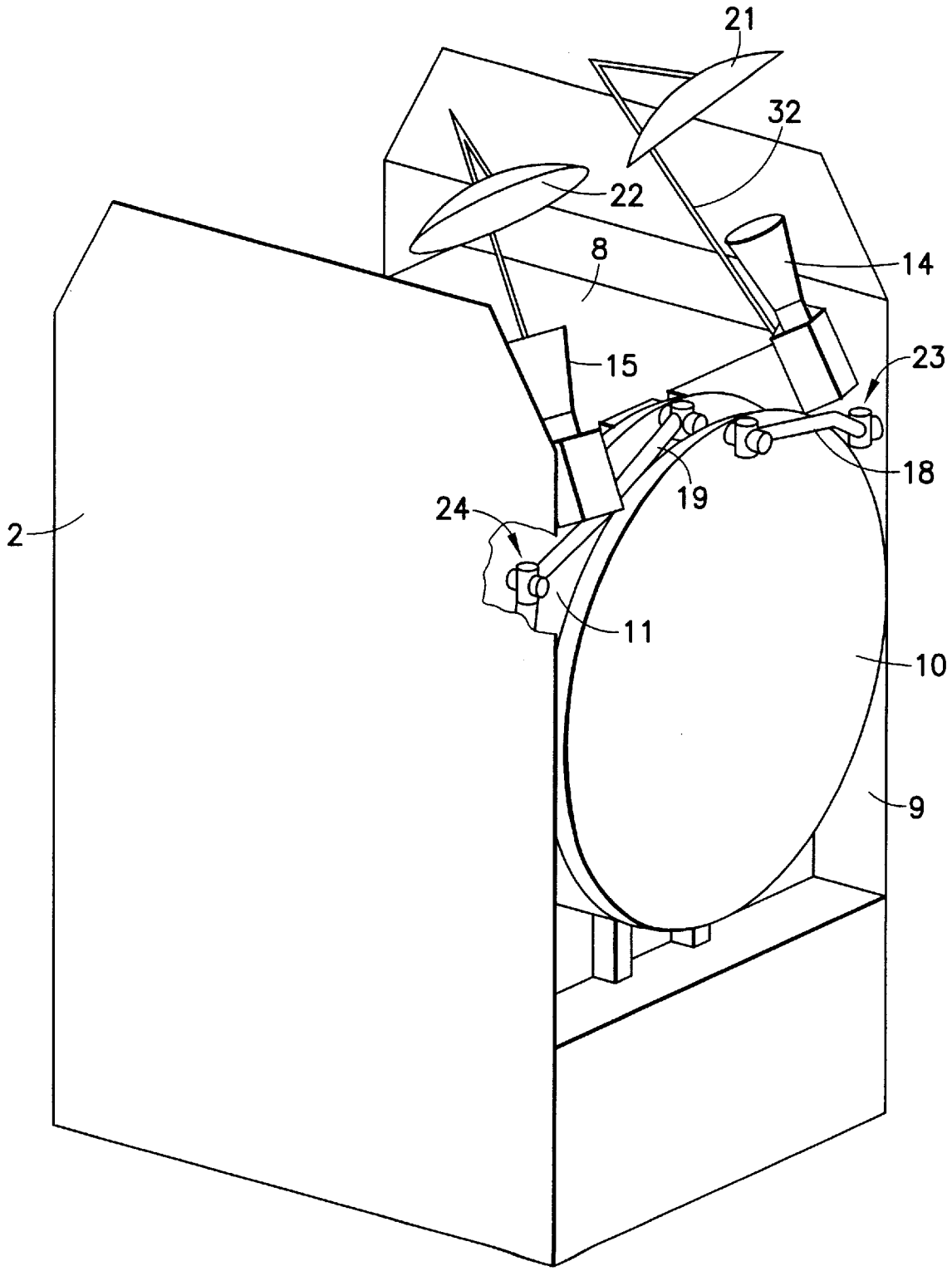
FIG. 3 is a perspective view of a satellite showing one side of an antenna sub-module with the reflectors nested in the stowed position.

In the system of this invention, an antenna sub-module 7 is constructed as shown in FIG. 2. Module 7 consists of a top mounting plate 8 and side support plates 9 which extend downward. A pair of antenna packs are mounted to the support plates 9 and each includes nested reflectors 10, 11, 12, and 13 with their associated signal feeds 14, 15, 16, and 17 (17 not shown). Mounting plate 8 is secured across the top of the satellite with the antenna packs extending downward on either side prior to deployment, as shown in FIG. 3. This modular construction allows the complete assembly of the antenna system for testing prior to installation on the satellite and facilitates the installation.

Figure 4:
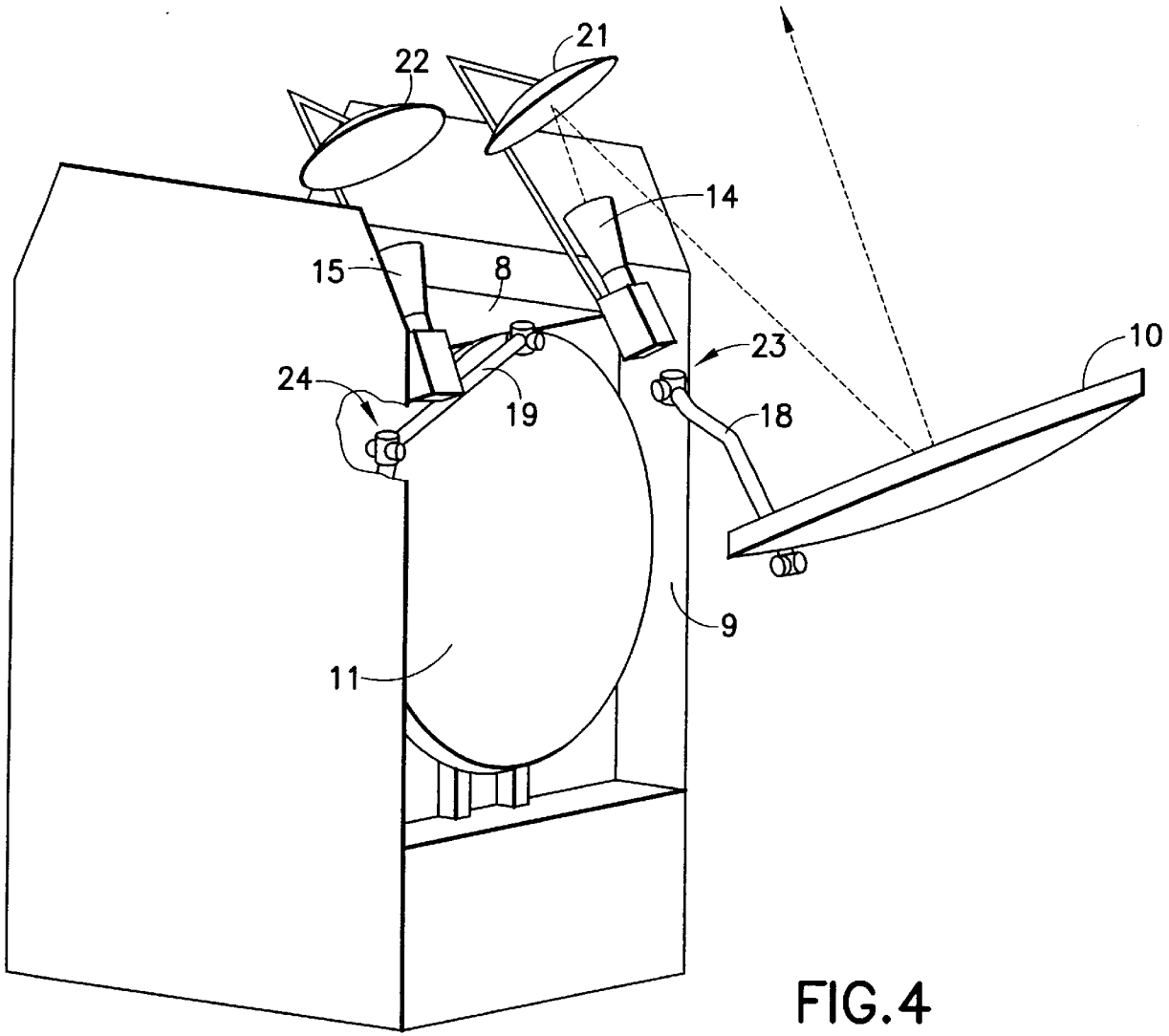
FIG. 4 is a perspective view of the antenna sub-module of FIG. 3 with one of the reflectors deployed.

Reflectors 10–13 are respectively mounted on independent support booms 18, and 19–20 (20 not shown). Reflector 10 is shown in the fully deployed position in FIG. 4. To accomplish this deployment, the boom 18 is connected to the antenna module 7 and its associated reflector 10 by a pair of two axis actuators which may be of the type described in U.S. Pat. No. 5,864,320 the disclosure of which is incorporated herein by reference.

Figure 5:
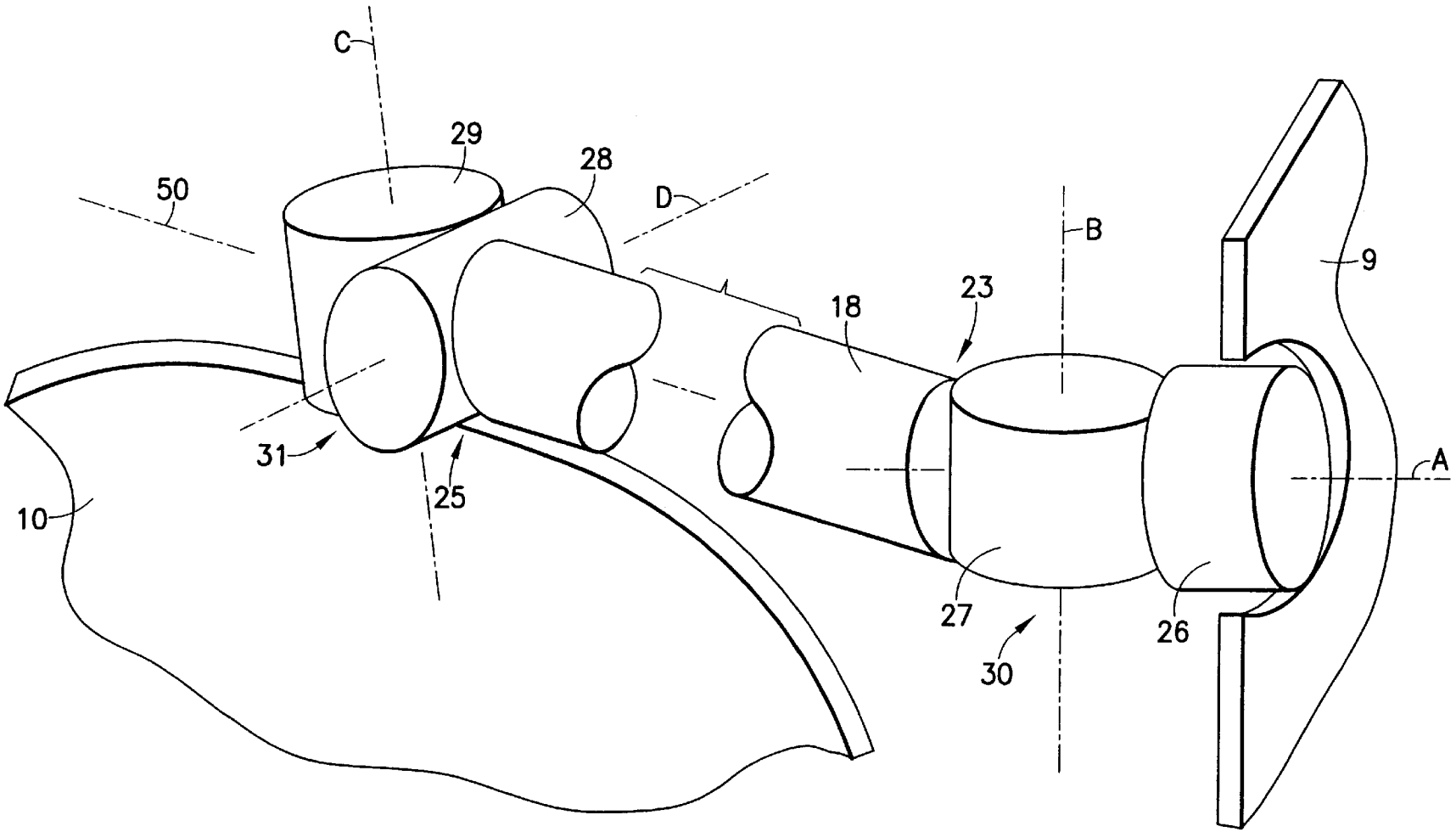
FIG. 5 is a perspective view of an reflector support boom constructed according to this invention.

The support boom 18 is shown in FIG. 5 and is connected at its outboard end 25 to reflector 10 by actuator assembly 30 and at its inboard end 23 to the satellite sub-module frame portion 9 by actuator assembly 30. Each of the end connections is made through two axis actuator assemblies 30 and 31. The actuator assemblies 30 and 31 may comprise spring biased gear mechanisms, as described in the above referenced '320 patent, they may also comprise a pair of stepping motor driven, reduction gear assemblies, as shown in FIG. 5. The use of stepping motor drives is preferred to provide a more accurate and adjustable deployment of the reflector 10. It should be noted that the feed assembly, consisting of feed horn 14, support boom 32 and sub-reflector 21 are fixed to satellite sub-module 7 on frame 9 in close proximity to the attachment point of boom 18.

In the preferred embodiment actuator assemblies 30 and 31 are driven through a series of deployment steps by electrically powered stepping motors 26 through 29. Actuation of the drive motors, cause the boom 18 and reflector 10 to rotate at each end about a pair of orthogonal axis identified by the reference letters A,B,C, and D in FIG. 5. The deployment motion may be controlled by digital signals, generated by a microprocessor component of the satellite computer according to preprogrammed instructions or manually by commands uploaded from ground control.

The sequence of motions will depend on the axial relationship of the individual actuators. Based on the orientation of the axis A-B shown in FIG. 5, an appropriate sequence of movements are shown in FIGS. 6*a*–6*e* to move the reflector 10 from its stowed position (see FIG. 2) to its deployed position (see FIG. 3).

Figure 6B:
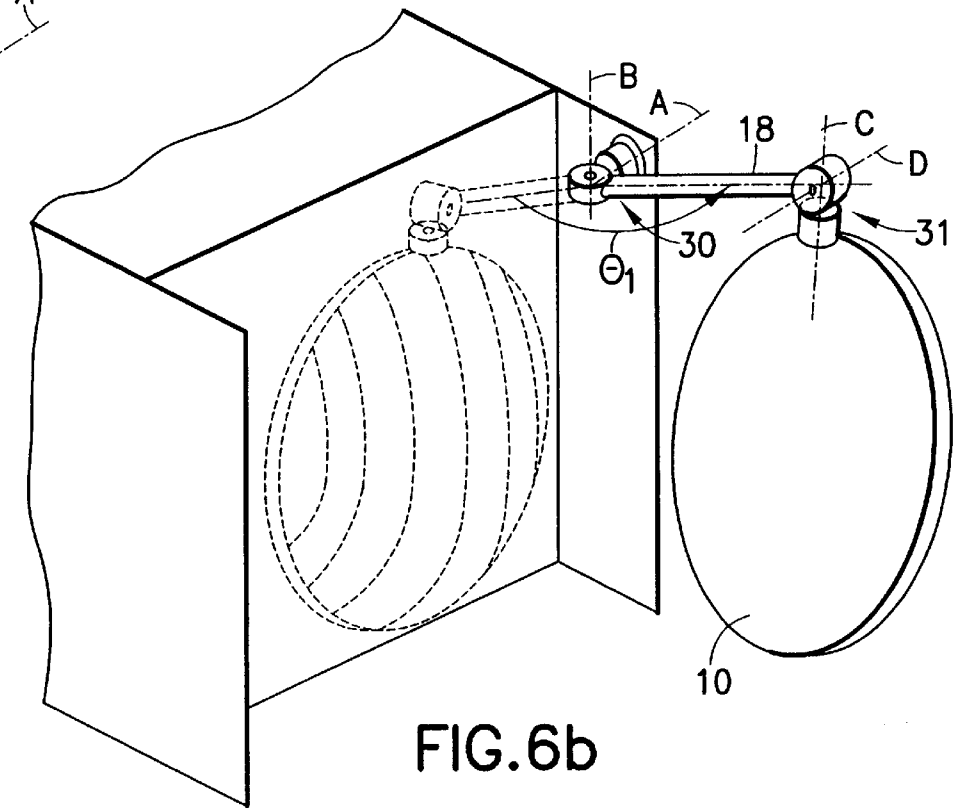
FIGS. 6*a* through 6*e* are perspective views of the satellite with the reflector at sequential position of deployment.
Figure 6A:
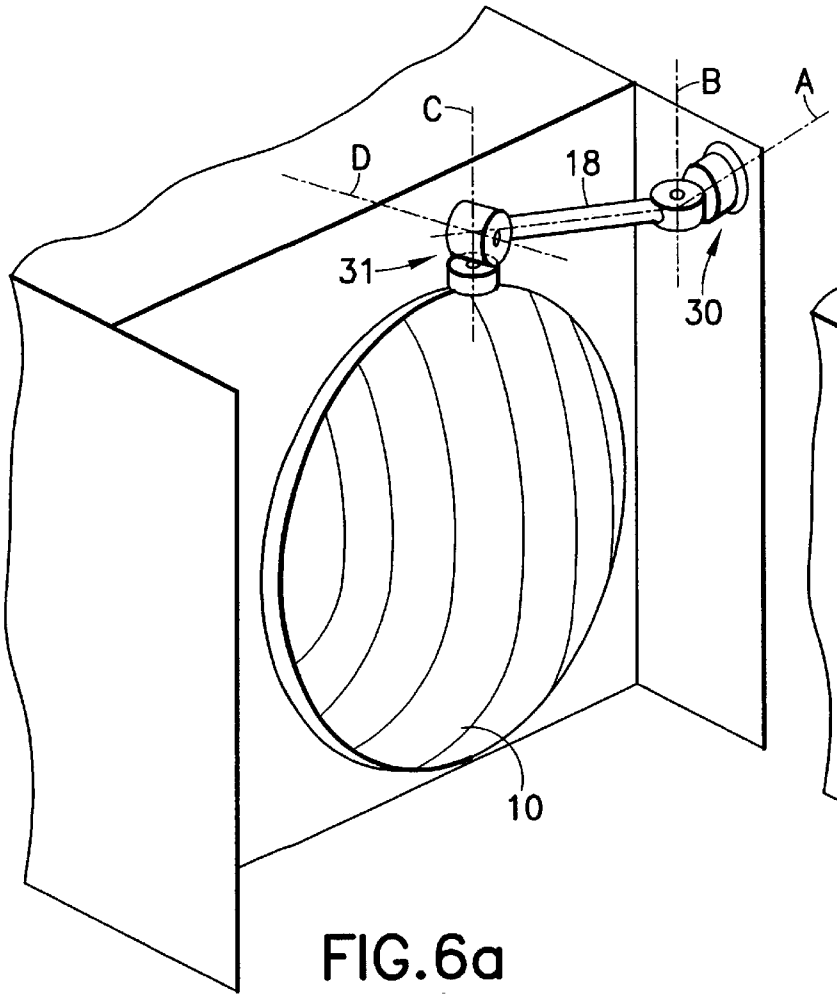
Figure 6C:
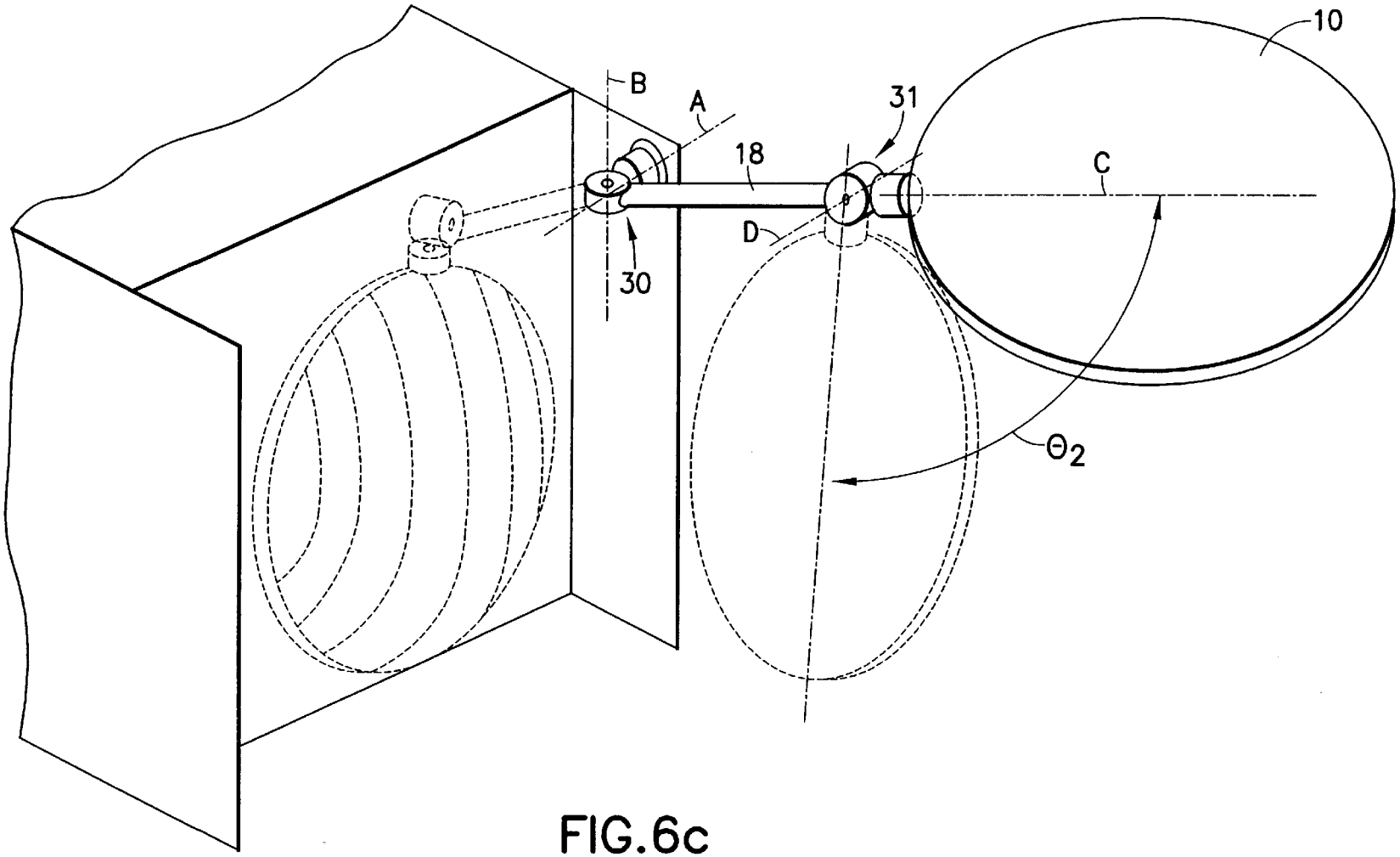
Figure 6D:
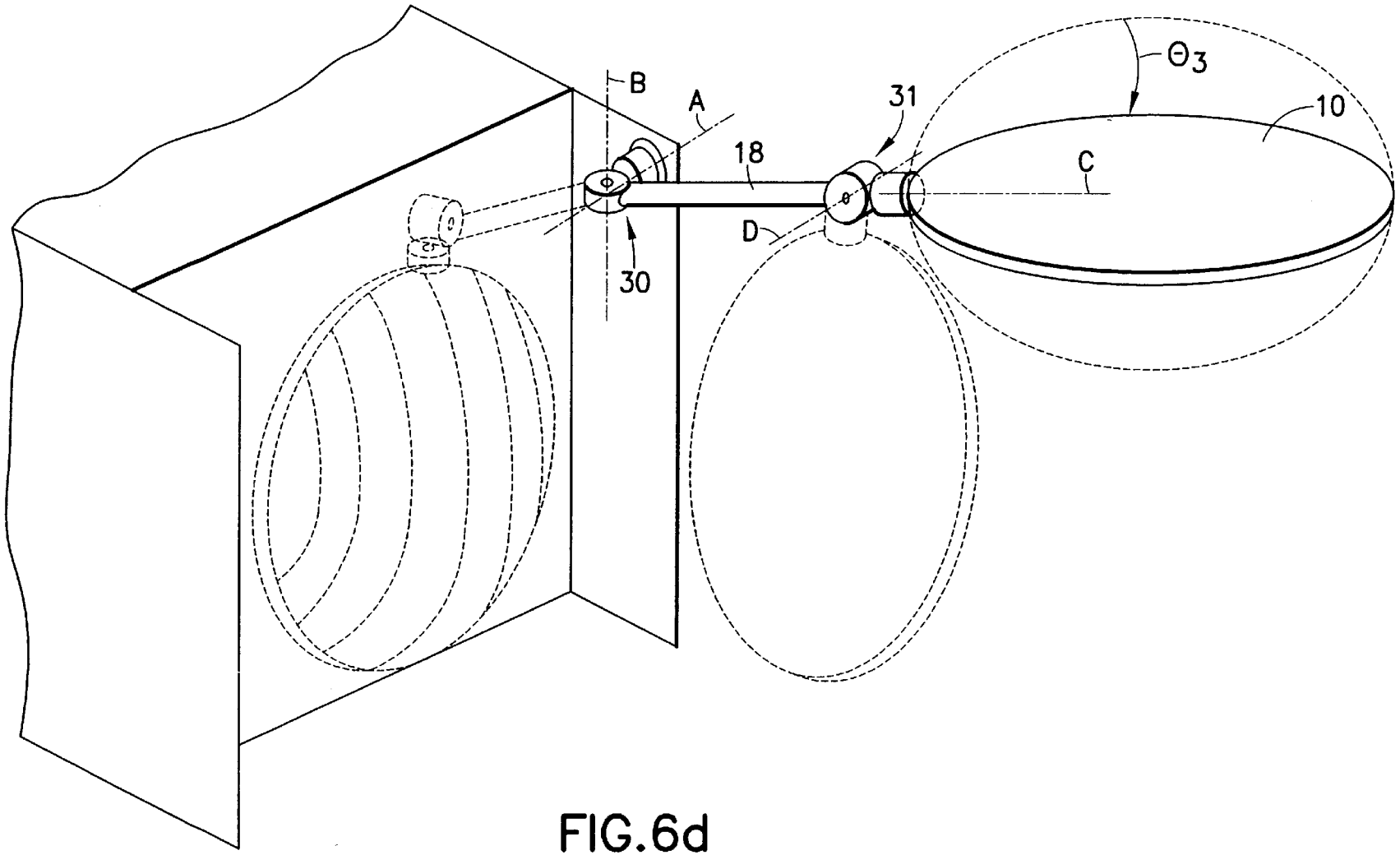
Figure 6E:
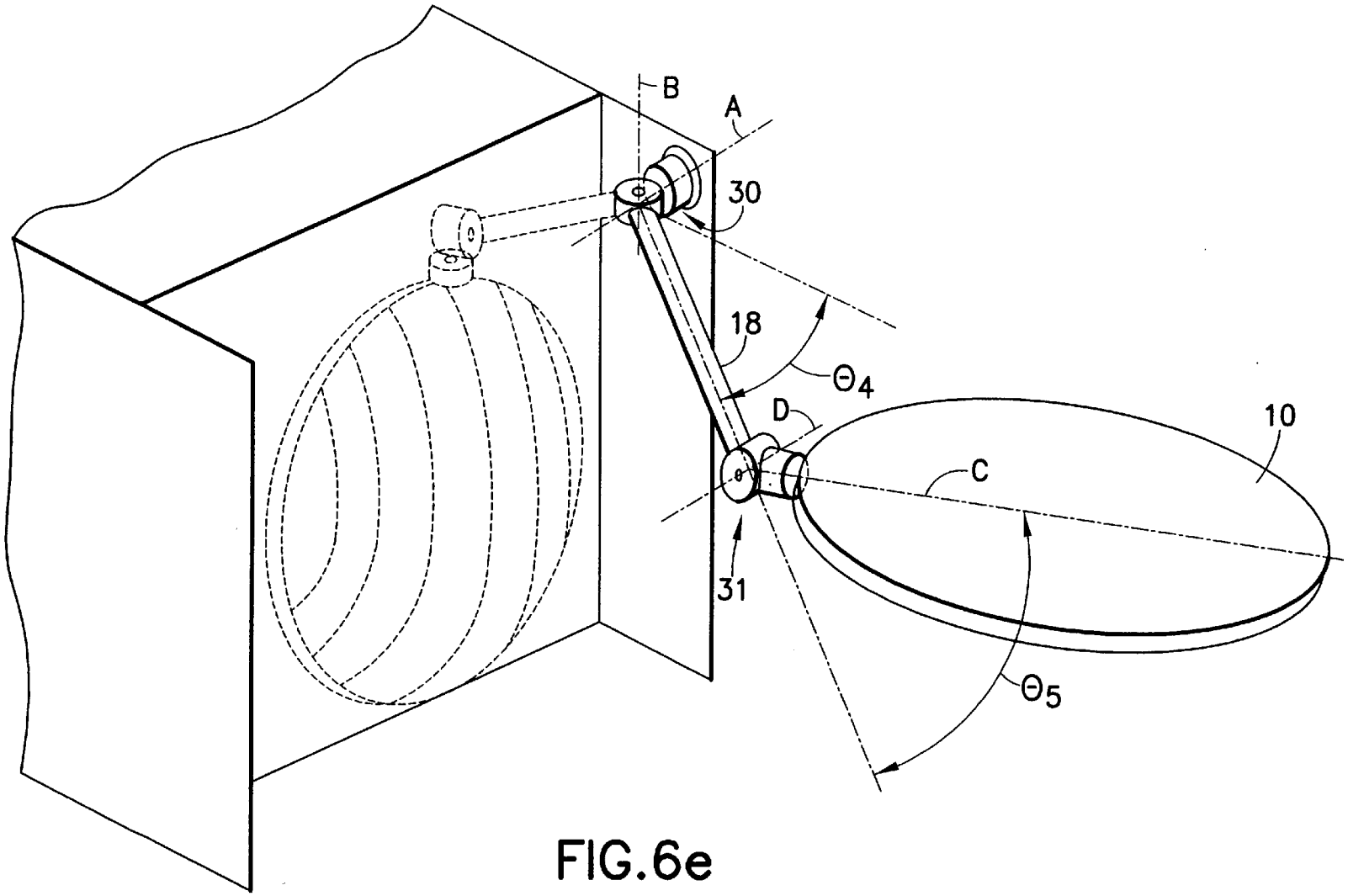

For clarity only the reflector 10 is shown in the series of FIGS. 6*a*–6*e*. The starting position of FIG. 6*a* has the reflector 10 in its nested position. To begin deployment a digital signal is sent to stepping motor 27 which prompts stepping motor 27 to rotate the boom 18 about axis B through an angle $\theta_1$ as shown in FIG. 6*b*. At this point boom 18 is partially deployed, but reflector 10 is not aligned with its sub-reflector 21. This will take several steps to accomplish. First reflector 10 is rotated about axis D by energizing stepping motor 28 to cause the pivoting of reflector 10 through angle $\theta_2$ as shown in FIG. 6*c*. FIG. 6*d* shows the rotation of the reflector 10 through an angle $\theta_3$ about axis C by actuation of stepping motor 29 to place the reflector in a closer position to receive signals from its feed assembly. To complete the alignment process, reflector 10 is pivoted downward about axis A by actuating stepping motor 26 through angle $\theta_4$ and further by triggering stepping motor 28 to pivot reflector 10 about axis D through an angle $\theta_5$, as shown in FIG. 6*e*. At this position, reflector 10 is positioned to receive signals from feed horn 14 via sub-reflector 21 and transmit the signals to a remote target for example another satellite or earth receiving station. The relative values of the angles $\theta$–$\theta_5$ will depend on the dimensions of the reflector and the clearances provided in the antenna envelop of satellite 1. It is readily observed that the order of motions may be reversed to stow the reflector or otherwise altered to accommodate the configuration of the components.

It should be appreciated from the above description that the other reflectors on the satellite antenna sub-module will be operated in a similar manner. The reflector 11, for example, can be deployed by movements which are the mirror image of the above motions.

In this manner an accurately adjustable mechanism is provided to nest an antenna array for launch and to deploy the antenna when the satellite has achieved orbit. The mechanism allows the mounting of the components of the antenna assembly to be mounted closely together on the satellite 1 to avoid distortion of the alignment of the antenna components due to thermal stress.

We claim:

1. Apparatus for movably supporting a reflector of an antenna assembly for a satellite, said assembly including a signal feed fixed to said antenna assembly at an attachment point, said apparatus comprising:

an elongated boom having a longitudinal axis and an inboard and outboard end, said inboard end attached to said satellite in close proximity to said attachment point of said signal feed;

a first pair of actuators constructed to provide rotary motion about first and second orthogonal axes, said first pair of actuators connected to said inboard end of said boom to provide motion of the boom relative to the satellite about said first and second axes;

a second pair of actuators constructed to provide rotary motion about third and forth orthogonal axes, said second pair of actuators connected to said outboard end of said boom and to said reflector to provide motion of the reflector relative to said boom about said third and fourth axes; and wherein said actuators are selectively driven to move said reflector on said boom between a position of being stowed to a position of being deployed and wherein, in said deployed position, said reflector is in accurate alignment with said signal feed.

2. Apparatus for movably supporting a reflector of an antenna assembly for a satellite, said assembly including a signal feed fixed to said antenna assembly at an attachment point, according to claim 1, wherein said actuators are dual spring biased gear mechanisms constructed to provide movement about orthogonal axes.

3. Apparatus for movably supporting a reflector of an antenna assembly for a satellite, said assembly including a signal feed fixed to said antenna assembly at an attachment point, according to claim 1, wherein said actuators are dual stepping motor driven, reduction gear assemblies constructed to provide movement about orthogonal axes.

4. An antenna sub-module for installation on a satellite comprising:

a structural bridge member removably fixed to said satellite and extending across said satellite from a first side to a second side of said satellite;

a pair of attachment plates fixed to said structural bridge member and oriented on each side of said satellite;

a plurality of signal feed assemblies each fixed to said antenna sub-module at a particular point of attachment;

a plurality of reflectors operatively associated with one of said signal feed assembly, each of said reflectors moveably supported on said antenna module by a support structure to move said reflector from a stowed position to a deployed position at which the reflector is aligned with said operatively associated signal feed, each of said support structures further comprising:

an elongated boom having a longitudinal axis and an inboard and outboard end, said inboard end attached to said satellite in close proximity to said attachment point of said signal feed;

a first pair of actuators constructed to provide rotary motion about first and second orthogonal axes, said first pair of actuators connected to said inboard end of said boom to provide motion of the boom relative to the satellite about said first and second axes;

a second pair of actuators constructed to provide rotary motion about third and forth orthogonal axes, said second pair of actuators connected to said outboard end of said boom and to said reflector to provide motion of the reflector relative to said boom about said third and fourth axes; and wherein said actuators are selectively driven to move said reflectors on said booms between said storage position to deployed position.

5. An antenna sub-module for installation on a satellite, according to claim 4, wherein said actuators are dual spring biased gear mechanisms constructed to provide movement about orthogonal axes.

6. An antenna sub-module for installation on a satellite, according to claim 4, wherein said actuators are dual stepping motor driven, reduction gear assemblies constructed to provide movement about orthogonal axes.

7. An antenna sub-module for installation on a satellite, according to claim 4, wherein the multiple reflectors comprise a pair of reflector packs, each of said packs comprised of two reflectors, said packs being attached to said attachment plates on either side of said satellite, wherein each of said reflectors of said packs are individually mounted on an independent boom.

8. An antenna sub-module for installation on a satellite, according to claim 7, wherein the movement of one reflector of said pack is the mirror image of the other.

* * * * *